US008459301B2

(12) United States Patent
Lorch

(10) Patent No.: US 8,459,301 B2
(45) Date of Patent: Jun. 11, 2013

(54) CONNECTING UNIT FOR SANITARY FITTINGS

(75) Inventor: Werner Lorch, Schramberg (DE)

(73) Assignee: Hansgrohe SE, Schiltach (DE)

( * ) Notice: Subject to any disclaimer, the term of this patent is extended or adjusted under 35 U.S.C. 154(b) by 453 days.

(21) Appl. No.: 12/712,297

(22) Filed: Feb. 25, 2010

(65) Prior Publication Data

US 2010/0224266 A1 Sep. 9, 2010

(30) Foreign Application Priority Data

Mar. 4, 2009 (DE) ..... 10 2009 012 840

(51) Int. Cl.
*F16K 11/20* (2006.01)

(52) U.S. Cl.
USPC ..... 137/597; 137/15.05; 137/603; 137/606; 137/614; 137/884; 4/695; 4/696

(58) Field of Classification Search
USPC ..... 137/15.01, 15.02, 15.04–15.06, 238, 137/597, 614, 846, 861, 606, 883, 884, 561 A, 137/602, 603, 896; 4/695, 696, 663
See application file for complete search history.

(56) References Cited

U.S. PATENT DOCUMENTS 5,492,143 A * 2/1996 Cooper et al. ..... 137/15.01
6,047,417 A * 4/2000 Derakhshan ..... 4/677
7,198,063 B2 * 4/2007 Abe ..... 137/606
2004/0211473 A1 * 10/2004 Smith ..... 137/597
2006/0065317 A1 * 3/2006 Higgins et al. ..... 137/884
2009/0314363 A1 * 12/2009 Schmidt ..... 137/607

FOREIGN PATENT DOCUMENTS

DE 3041712 A1 5/1982
DE 3807844 A1 9/1989
DE 19525358 A1 1/1997
DE 19856157 A1 6/2000
EP 0790448 A2 8/1997

OTHER PUBLICATIONS

Machine translation of DE 3807844.*
Machine translation of DE 3041712.*
Machine translation of EP 0790448.*
German Patent Office, Official Action dated Oct. 26, 2009, in corresponding German Patent Application No. 10 2009 012 840.9-25.
EPO Search Report in application EP 10 15 4195, dated Dec. 28, 2011.

* cited by examiner

*Primary Examiner* — Craig Schneider
*Assistant Examiner* — Ian Paquette
(74) *Attorney, Agent, or Firm* — Duane Morris LLP

(57) ABSTRACT

A connecting unit for a sanitary fitting is proposed, said connecting unit having, on one side thereof, plug-in sockets for connection to plug-in nipples of the sanitary fitting. On the opposite side, the connecting unit contains connections for the domestic installation pipes. The sanitary fitting and the connecting unit are connected by plugging in a direction parallel to the wall surface.

The connecting unit may contain a flushing pipe which is designed as a continuous bore. When the connecting unit is not yet connected to the sanitary fitting, said flushing pipe can be used to flush out the pipes. Said flushing pipe is stopped from functioning when the connection between the sanitary fitting and the connecting unit is produced.

18 Claims, 2 Drawing Sheets

CONNECTING UNIT FOR SANITARY FITTINGS

The invention relates to a connecting unit for sanitary fittings.

The use of connecting units for mounting sanitary fittings, in particular complex sanitary fittings, is known. The connecting units are connected to the domestic installation pipes: both to the feed pipes and to the discharge pipes. The connecting units themselves have passages which open out in a planar surface, for example. The sanitary fitting is then connected to the connecting unit in such a way that the mouths of the passages are connected to the inlets into the sanitary fitting and the outlets from the sanitary fitting. Said division has the advantage that the sanitary fittings do not need to be mounted until the network of pipes has been completed. In addition, an appropriate configuration allows different sanitary fittings to be connected to the same connecting units at all times.

Before operation commences, the network of pipes of a domestic installation have to be flushed-through in order to flush out from the pipes any dirt formed during laying of the pipes or chips produced during machining of the pipes. This preferably takes place before the complex sanitary fittings are installed.

For this purpose, it has been proposed to attach to a fully installed connecting unit, instead of the sanitary fitting, a flushing unit which can connect the pipes connected to the connecting unit by internal passages. Said flushing unit is removed again once flushing-out has been successfully completed (DE 19856157). The flushing unit, like the sanitary fitting after it, is placed against the connecting unit and fastened there from the front, i.e. perpendicularly with respect to the surface of the wall in front of which the fitting is attached.

Fittings are also known containing electronic components for activating the fittings and/or for monitoring the operation of the fittings. Said electronic components are frequently accommodated in a separate box also containing the electrical components, for example drives.

The invention is based on the object of allowing connections between a domestic installation and even complex fittings to be produced without operating errors and without additional labour.

In order to achieve said object, the invention proposes a connecting unit for sanitary fittings having the features mentioned in claim 1. Developments of the invention form the subject-matter of sub-claims.

Once the fitter has connected the pipes to the connecting unit, he therefore does not have to worry about subsequently attaching a flushing unit; on the contrary, he can use the flushing pipe contained in the connecting unit for flushing out the pipes. A complex flushing unit is no longer necessary. The fitting-side openings can be closed by simple stoppers. Said embodiment allows a flushing-out and subsequently a test for tightness of the network of pipes to be carried out even when there is no room to attach a flushing unit because, for example, the sanitary fitting cannot be connected to the connecting unit from the front.

In particular, the invention may be applied in a connecting unit to which the sanitary fitting is connected in a direction parallel to the wall surface.

Connecting units of this type are frequently designed in such a way that the axis of the connections to the connecting unit also runs parallel to the wall surface.

In a development of the invention, provision may be made for the connections for the pipes to be arranged on that side of the connecting unit which faces away from the sanitary fitting.

For connecting between the connecting unit and the sanitary fitting, a development may provide for said connecting means to be plug-in connecting means which, by simply being plugged in, cause a mechanical and a hydraulic connection between the two parts. For example, a development may provide for the plug-in connecting means to have a plug-in socket into which a plug-in nipple is plugged. According to the invention, provision may be made for the plug-in sockets to be formed in the connecting unit, while the plug-in nipples are part of the sanitary fitting.

According to the invention, a development may provide for the plug-in nipples to have in their end region a seal, in particular a peripheral seal in the form of an O-ring which interacts with the wall of the plug-in socket for sealing. This means that the point at which the seal is produced is arranged set apart from the outer side of the connecting unit or the sanitary fitting.

According to the invention, a development may provide for the flushing pipe to be connected to the plug-in sockets in the region between the outer side of the connecting unit and the sealing region. By producing the plug-in connection, the flushing pipe is thus stopped from functioning without its mouth being directly sealed into the plug-in socket.

In still another development of the invention, provision may be made for the flushing pipe to pass eccentrically through the plug-in sockets. It is possible for the flushing pipe to be designed as a single bore.

Once the plug-in connection has been produced, the plug-in connection must be mechanically secured so as to prevent it from becoming undone. This may for example take place in that securing means act transversely with respect to the plug-in direction.

For example, it is possible to use for this purpose bolts or studs which are inserted into the connecting unit transversely with respect to the plug-in direction between the sanitary fitting and said connecting unit and secure at least one of the plug-in nipples in the connecting unit in a form-fitting manner. Said securing between the bolts and the plug-in nipple can advantageously also be carried out in the region between the outer side of the connecting unit and the sealing region of the plug-in nipple.

The bolt may in particular be a partially threaded bolt, i.e. one which is screwed into the connecting unit and is secured by a threaded portion. Said bolt can also be screwed into the connecting unit and be removed therefrom from the front.

In still another development of the invention, provision may be made for the connecting unit to have an initial block, which can in particular also be operated from the front, for each of the two inlets.

Provision may also be made for the connecting unit to have a strainer for each of the two inlets, wherein said strainer can also advantageously be inserted into the connecting unit transversely with respect to the connection direction between the sanitary fitting and connecting unit.

It has proven particularly beneficial to accommodate said strainer in the initial block itself, so that it can be removed and cleaned whenever the initial block is switched on.

Further features, details and advantages of the invention emerge from the claims and the abstract, the wording of both of which is incorporated into the description by reference, the following description of preferred embodiments of the invention and with reference to the drawings, in which:

Figure 1:
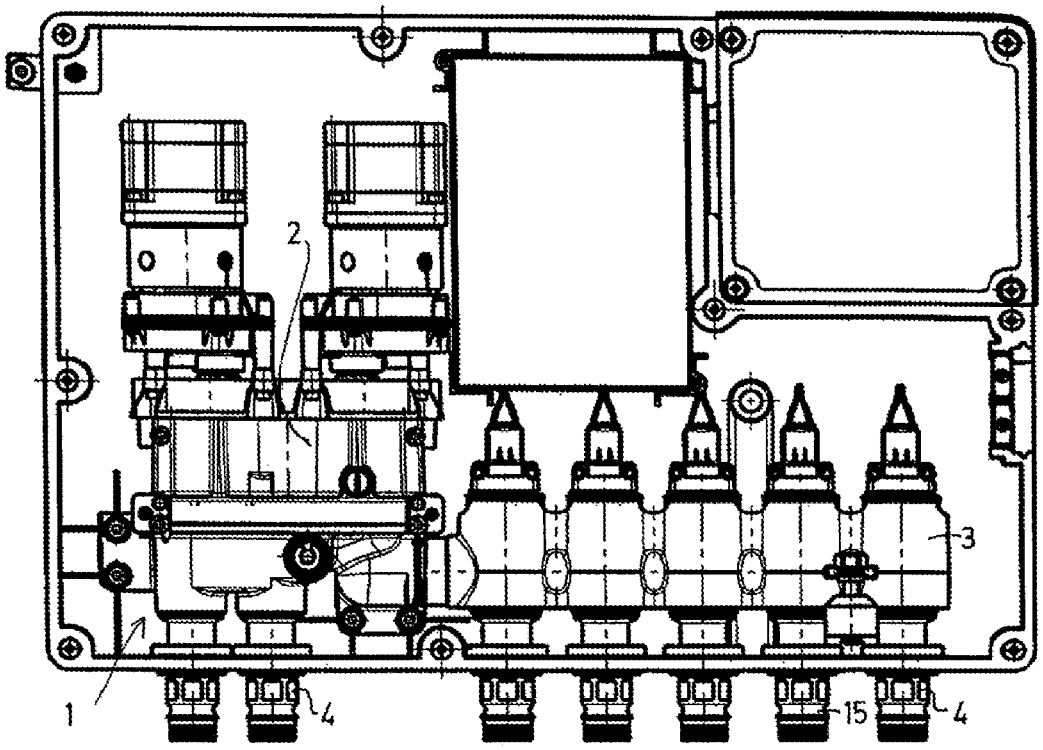
FIG. 1 is a plan view onto a sanitary fitting.

FIG. 1 is a plan view of an opened box in which a sanitary fitting 1 is accommodated. Said box with the sanitary fitting 1 is fastened to a wall, so that the viewing direction of FIG. 1 is directed onto the wall. The sanitary fitting contains drives and controls which will not be examined individually. The sanitary fitting 1 contains a mixing valve 2 in which a quantitative control is also accommodated. A large number of outlet valves 3, which are supplied with mixed water from the mixing valve 2, are flanged laterally onto the mixing valve 2. The outlet valves 3 are activated electrically. The electronics required for this purpose are accommodated in components within the box.

A plurality of plug-in nipples 4 protrude from the box on the lower side in FIG. 1. Said plug-in nipples 4 serve to connect the sanitary fitting to domestic installation water pipes. In the illustrated exemplary embodiment, all the plug-in nipples 4 are the same size and are also identically designed in all other respects. They protrude from the planar underside of the box perpendicularly and all end in the same plane.

Figure 2:
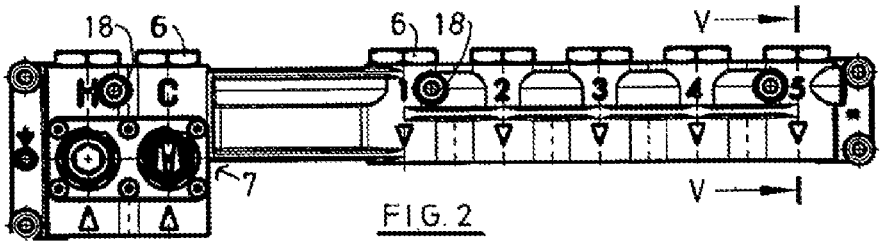
FIG. 2 shows a connecting unit, illustrated from the same direction, for the sanitary fitting from FIG. 1.

FIG. 2 shows a connecting unit which is intended to be used to connect the domestic installation pipes to the sanitary fitting 1 in the box. FIG. 2 is a view from the same direction as FIG. 1. A plug-in socket 5, which in the state illustrated in FIG. 2 is closed by a stopper 6, is associated with each plug-in nipple 4 of the sanitary fitting. At the left end in FIG. 2, the connecting unit is widened. Two initial blocks 7, which can be rotated using a key, are arranged there. The two conduits, which may be seen on the left in FIG. 2 and lead through the connecting unit, are intended for the feed pipe, while the other conduits through the connecting unit are intended for the pipes leading to the consumers. This is indicated by the arrow markings on the upper side of the connecting unit.

Figure 3:
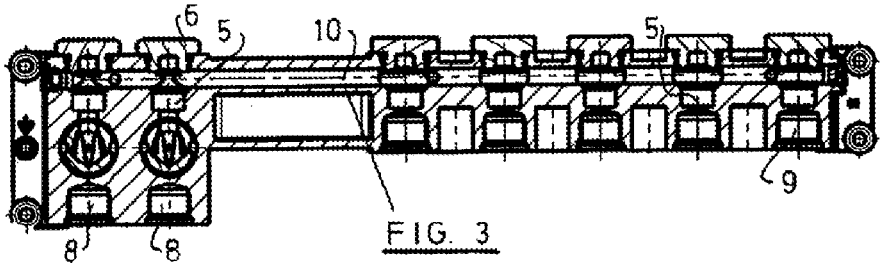
FIG. 3 is a section through the connecting unit in a plane parallel to the view of FIG. 2.

Now, FIG. 3 is a section through the connecting unit in a plane running parallel to the drawing plane of FIG. 2. On the side facing away from the sanitary fitting, there are two connections 8, which are each connected to a conduit through the connecting unit, for the feeding of warm and cold water. The conduit ends in each case in a plug-in socket 5. In the illustration of FIG. 3 too, the conduits on the side facing toward the sanitary fitting are closed by a stopper 6.

There are the same connections 9 for the pipes leading away from the sanitary fitting, said connections 9 also being rectilinearly connected to the plug-in sockets 5.

A flushing pipe 10 in the form of a passage passes through the connecting unit. Said passage is designed as a bore which extends continuously from one end side to the other end side and is closed off at both ends by a stopper 11. It is also conceivable to design said passage as a blind hole, so that a stopper 11 is required only on one side.

As may be seen from the section of FIG. 3, the flushing pipe 10 is connected to all the plug-in sockets.

The connecting unit proposed by the invention is used as follows. Firstly, the connecting unit is connected, in the state as shown in FIGS. 2 and 3, to the domestic installation pipes at the point where the sanitary fitting is to be attached. That is to say, the pipe supplying the hot or cold water is connected to the connections 8 and the pipes leading to the consumers, i.e. for example the pipe to a shower, to a bathtub inlet or the like, are connected to the connections 9.

If then, for example, the cold water pipe is provided with water, said water can pass through the flushing pipe 10 to all the outlets through the connecting unit. This allows the pipes to be flushed out. Similarly, it is also possible to check the pressure of pipes.

When said activity has been carried out, the stoppers 6 are removed and the box with the sanitary fitting is displaced in a direction parallel to the wall with the connecting nipples 4 in front in the direction toward the connecting unit, so that the connecting nipples 4 engage with the plug-in sockets 5.

Figure 4:
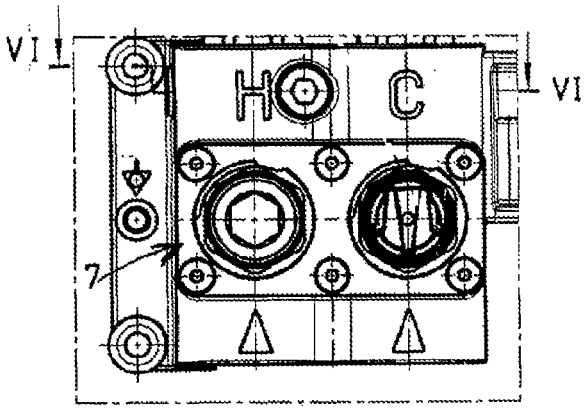
FIG. 4 is a plan view onto the left end of the connecting unit.

FIG. 4 is an enlarged plan view onto the left end region of the connecting unit. At said point, it is possible to access the aforementioned initial block 7. The initial block is accessed from the front of the connecting unit, i.e. from a direction perpendicular with respect to the wall surface and thus also perpendicular with respect to the connection direction between the sanitary fitting and the connecting unit.

Figure 5:
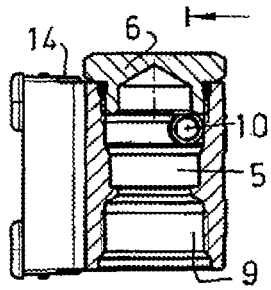
FIG. 5 is a section through the connecting unit.

FIG. 5 is a cross section through the connecting unit at the level of a plug-in socket for a plug-in nipple of an outlet valve 3. The plug-in socket 5 is still closed with the stopper 6. The flushing pipe 10, which is designed as a bore, runs at the edge of the plug-in socket 5 in a region of the plug-in socket 5 where the diameter thereof is somewhat larger than in the end region of the plug-in socket. The point where the flushing pipe 10 traverses the plug-in sockets 5 is positioned in the axial direction of the plug-in socket 5 roughly at the centre, between the part where the thread is present for the stopper 6 and the end region of smaller diameter.

Figure 8:
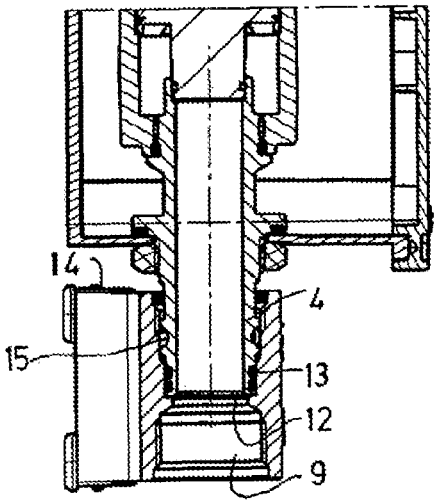
FIG. 8 is a section, corresponding to FIG. 7, through another connection.

FIG. 8, which will now be referred to, shows the state of the connection between the sanitary fitting and the connecting unit at said point. The plug-in nipple 4 is now plugged into the plug-in socket 5 until its free end 12 abuts the transition between the plug-in socket 5 and the connection 9. In its end region, the plug-in nipple 4 has one or two peripheral seals 13 which serve to sealingly abut the end region of the wall of the plug-in socket 5. The seal between the plug-in socket 5 and the plug-in nipple 4 therefore takes place in the end region of the plug-in nipple 4. The point where the flushing pipe 10 is connected to the plug-in sockets 5 is closer to that outer side 14 of the connecting unit which faces toward the sanitary fitting 1. As a result, the flushing pipe 10 is stopped from functioning as soon as the plug-in nipple

4 is inserted into the plug-in sockets 5. The mouth of the flushing pipe 10 into each of the plug-in sockets 5 does not itself need to be sealed.

Figure 6:
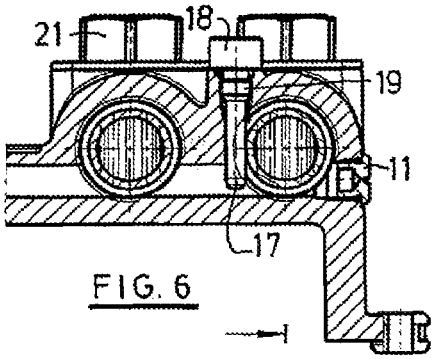
FIG. 6 is a further section through the connecting unit at the level of the feed pipes.

As may also be seen from the section of FIG. 8, the plug-in nipple 4 has a peripheral groove 15 at precisely the point where the flushing pipe 10 opens into the plug-in socket 5. Said peripheral groove 15 may also be seen in the view of FIG. 1; however, only now does its importance become clear. In order to describe this in greater detail, reference will now be made to FIG. 6 which is a section through the end of the connecting unit illustrated in FIG. 4. Studs 17, which are again screwed into the connecting unit from the upper side of the connecting unit, i.e. perpendicularly with respect to the wall surface, serve to lock the connecting unit in relation to the sanitary fitting. Said stud engages with the aforementioned groove 15 of the plug-in nipple 4. The stud 17 has in the region below its head 18 a threaded portion 19 with which it is screwed in. The front region of the stud 17 can be designed so as to have a smooth surface. It is positioned in the aforementioned groove 15. In this way, one or two studs 17 can be used to produce a lock between the sanitary fitting and the connecting unit. Said lock is form-fitting.

Figure 7:
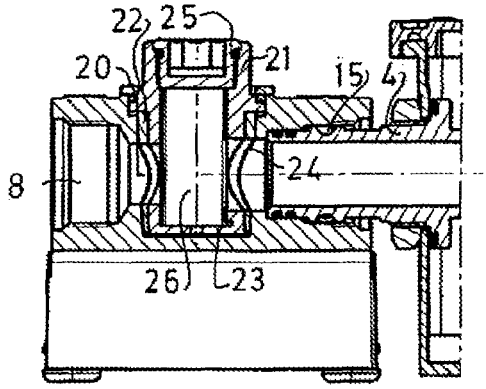
FIG. 7 is a further cross section through the connecting unit with the plug-in nipple inserted.

Reference will now be made to FIG. 7 which is a section through the connecting unit at the level of a conduit for a feed pipe. Again, the plug-in nipple 4 is plugged into the plug-in socket 5. The connection between the connection 8 for a feed pipe and the plug-in socket 5 passes through a passage 20 in the form of a smooth-surfaced bore through which the initial block 7 passes. The initial block contains a hub 21 with which a cylindrical sleeve 22 is rotationally engaged. The cylindrical sleeve 22 has a closed bottom 23. The cylindrical sleeve contains in its wall two openings 24 which correspond to the contour of the passage 20. In the position illustrated in FIG. 7, said openings 24 are aligned with the passage 20, so that the flow from the connection 8 into the plug-in nipple 4 is unimpeded. If, on the other hand, the hub 21 is used to rotate the initial block 7 through 90° about the axis of the sleeve 22, then the two openings 24 are positioned transversely with respect to the axis of the passage 20 and block the conduit.

An insert, which is mounted in the hub 21 and has a sealed head 25, is arranged in the sleeve 22. A strainer 26, which reaches down to the bottom 23, is attached to the head 25. Said strainer 26, which is designed as a concertina, is folded and thus offers large throughflow areas and a lot of space for the accumulation of dirt. The water therefore flows through it several times. If the initial block is actuated, that is to say the conduit through the passage 20 is closed by rotating the initial block, the strainer 26 can be removed and cleaned.

The section of FIG. 7 also shows the groove 15 of the plug-in nipple 4.

As may be seen from the plan view of FIG. 2, there are three studs 17 of this type each having their own head 18.

What is claimed is:

1. A connecting unit for use in conjunction with a sanitary fitting adapted to couple two supply lines of a house installation to at least one water outlet, the connecting unit comprising:

two input connections adapted to be connected to pipes of a house installation, at least one output connection adapted to be connected to an outgoing pipe leading to a water outlet, and a plug-in connector configured for engagement by plug-in connections, between the connecting unit and the sanitary fitting, wherein each of the two input and at least one output connections of the connecting unit is placed so as to couple through a respective one of said plug-in connections to a corresponding said plug-in connector of the sanitary fitting, in a connected state of the unit and the sanitary fitting, and, wherein the two input and at least one output connections for the pipes are arranged on that side of the connecting unit which faces away from the sanitary fitting.

2. The connecting unit according to claim 1, wherein the plug-in connections between the connecting unit and the sanitary fitting are directed along lines running parallel to a surface of a wall.

3. The connecting unit according to claim 2, wherein the two input and at least one output connections with the connecting unit are directed along lines running parallel to the surface of the wall.

4. The connecting unit according to claim 1, wherein an initial shut-off device is arranged in the connecting unit for each inlet into the connecting unit.

5. The connecting unit according to claim 4, wherein the initial shut-off device runs transversely with respect to a connecting direction between the sanitary fitting and the connecting unit.

6. The connecting unit according to claim 1, wherein the plug-in connector comprises a plug-in socket and a plug-in nipple which can be inserted into the plug-in socket.

7. The connecting unit according to claim 6, wherein the plug-in sockets of said connections are formed on the connecting unit.

8. The connecting unit according to claim 6, wherein a seal between the plug-in nipple and the plug-in socket is provided in a region of an inner end of the plug-in socket and a free end of the plug-in nipple.

9. The connecting unit according to claim 1, wherein a said plug-in connector between the sanitary fitting and the connecting unit is secured by a lock acting transversely with respect to a connection direction.

10. The connecting unit according to claim 9, further comprising bolts which secure the plug-in nipples in the connecting unit in a form-fitting manner.

11. The connecting unit according to claim 10, wherein the bolts are screwed into the connecting unit.

12. A connecting unit for a sanitary fitting, the connecting unit comprising:

two input connections to be connected to pipes of a house installation, at least one output connection for an outgoing pipe leading to a water outlet and a plug-in connector for producing a plug-in connection between the connecting unit and the sanitary fitting, wherein each of the input and output connections leads to a respective said plug-in connection which is connected with a corresponding said plug-in connector of the sanitary fitting in a connected state of the unit and the sanitary fitting, and further comprising a flushing pipe configured as a passage in the connecting unit, wherein the flushing pipe connects the input connections to the output connections, and is designed in such a manner that the flushing pipe is stopped from functioning when the plug-in connection between the connecting unit and the sanitary fitting is produced.

13. The connecting unit according to claim 12, wherein the flushing pipe is connected to the plug-in sockets in a region between an outer side of the connecting unit and a sealing region.

14. The connecting unit according to claim 12, wherein the flushing pipe passes eccentrically through the plug-in sockets.

15. A connecting unit for use in conjunction with a sanitary fitting adapted to couple two supply lines of a house installation to at least one water outlet, the connecting unit comprising:

two input connections adapted to be connected to pipes of a house installation, at least one output connection adapted to be connected to an outgoing pipe leading to a water outlet, and a plug-in connector configured for engagement by plug-in connections, between the connecting unit and the sanitary fitting, wherein each of the two input and at least one output connections of the connecting unit is placed so as to couple through a respective one of said plug-in connections to a corresponding said plug-in connector of the sanitary fitting, in a connected state of the unit and the sanitary fitting, further comprising a strainer arranged in the connecting unit for each inlet into the connecting unit, and, wherein the strainer is arranged in an initial shut-off device.

16. A connecting unit for use in conjunction with a sanitary fitting adapted to couple two supply lines of a house installation to at least one water outlet, the connecting unit comprising:

two input connections adapted to be connected to pipes of a house installation, at least one output connection adapted to be connected to an outgoing pipe leading to a water outlet, and a plug-in connector configured for engagement by plug-in connections, between the connecting unit and the sanitary fitting, wherein each of the two input and at least one output connections of the connecting unit is placed so as to couple through a respective one of said plug-in connections to a corresponding said plug-in connector of the sanitary filling, in a connected state of the unit and the sanitary fitting, further comprising a strainer arranged in the connecting unit for each inlet into the connecting unit, and, wherein, in an initially blocked state, the strainer can be removed perpendicularly with respect to a wall surface.

17. A connecting unit for use in conjunction with a sanitary fitting adapted to couple two supply lines of a house installation to at least one water outlet, the connecting unit comprising:

two input connections adapted to be connected to pipes of a house installation, at least one output connection adapted to be connected to an outgoing pipe leading to a water outlet, and a plug-in connector configured for engagement by plug-in connections, between the connecting unit and the sanitary fitting, wherein each of the two input and at least one output connections of the connecting unit is placed so as to couple through a respective one of said plug-in connections to a corresponding said plug-in connector of the sanitary filling, in a connected state of the unit and the sanitary fitting, and, wherein a flushing pipe runs transversely with respect to a connecting direction between the sanitary fitting and the connecting unit.

18. In combination, a sanitary fitting adapted to couple two supply lines of a house installation to at least one water outlet, and connecting unit for use in conjunction with the sanitary fitting, wherein the connecting unit has two input connections adapted to be connected to water supply pipes of a house installation, at least one output connection adapted to be connected to an outgoing pipe leading to a water outlet, and a plug-in connector configured for engagement by plug-in connections, between the connecting unit and the sanitary fitting, wherein each of the two input and at least one output connections of the connecting unit is placed so as to couple through a respective one of said plug-in connections to a corresponding said plug-in connector of the sanitary fitting, in a connected state of the unit and the sanitary fitting; and, wherein the two input and at least one output connections for the pipes are arranged on that side of the connecting unit which faces away from the sanitary fitting.

* * * * *